United States Patent [19]

Brault

[11] 4,449,947

[45] May 22, 1984

[54] FLOTATION DEVICE

[76] Inventor: Richard A. Brault, 283 Sherbourne St., Apt. 2, Toronto, Canada

[21] Appl. No.: 393,508

[22] Filed: Jun. 29, 1982

[51] Int. Cl.[3] ..... B63C 9/10

[52] U.S. Cl. ..... 441/81

[58] Field of Search ..... 441/80, 81, 82, 83, 441/88, 89, 133

[56] References Cited

U.S. PATENT DOCUMENTS

| | | | |
|---|---|---|---|
| 2,105,110 | 1/1938 | Driscoll et al. | 441/81 |
| 2,342,868 | 2/1944 | King | 441/81 |
| 2,801,114 | 7/1957 | Chapman | 280/480 |
| 3,372,412 | 3/1968 | Robertson | 441/81 |

*Primary Examiner*—Trygve M. Blix
*Assistant Examiner*—Patrick W. Young
*Attorney, Agent, or Firm*—Fetherstonhaugh & Co.

[57] ABSTRACT

A flotation device such as a life buoy comprises a flotation member in the form of a buoyant body of foamed plastic material having a support surface extending about a perimeter thereof. A retrieval member is connected to the flotation member and is in the form of an elongated web. The web is connected to the flotation member in a manner such that it is positioned to be located in an operable position extending from its connection with the flotation member and a storage position extending about the support face.

4 Claims, 3 Drawing Figures

FLOTATION DEVICE

FIELD OF THE INVENTION

This invention relates to flotation devices. In particular this invention relates to a life buoy flotation device.

PRIOR ART

Flotation devices such as life buoys generally consists of a flotation member and a retrieval cord or rope, one end of which is secured to the flotation device. The remainder of the rope is wound upon itself and stored adjacent the flotation member. In order to use the flotation member, it is necessary to unwind the retrieval cord so that its full length can be utilized for retrieval purposes. In most instances there is an urgent need to use the flotation device as quickly as possible and difficulties can result from delays in attempting to unravel the retrieval cord. Furthermore, the retrieval cord can become wound around support structure upon which the life buoy is mounted making the removal of the life buoy from its support difficult and time consuming.

I have found that the retrieval member of a flotation device can be conveniently stored and easily released with respect to a flotation member by forming a support face on a perimeter of the flotation member and wrapping the retrieval member around the support face.

I have further found that a short retrieval member may be provided in the form of an endless loop, the length of which is substantially equal to the length of the perimeter on which the support surface is formed so that the loop is self-supporting on the support surface when located in the storage position.

When a long length of retrieval member is required, I connect one end of the retrieval member to the flotation member at the support surface and I wind the remainder of the web around the support surface and releasably secure the other end of the web at the support surface.

SUMMARY OF INVENTION

According to one aspect of the present invention, a flotation device comprises the flotation member which consists of a buoyant body of foamed plastics material having a support face extending about the perimeter thereof, a retrieval member comprising an elongated web of flexible material. The web is connected to the flotation member and is adapted so as to be locatable in an operable position extending from its connection with said flotation member and a storage position extending about said support face.

The invention will be more clearly understood as a reference to the following detailed specification read in conjunction with the drawings wherein.

Figure 1:
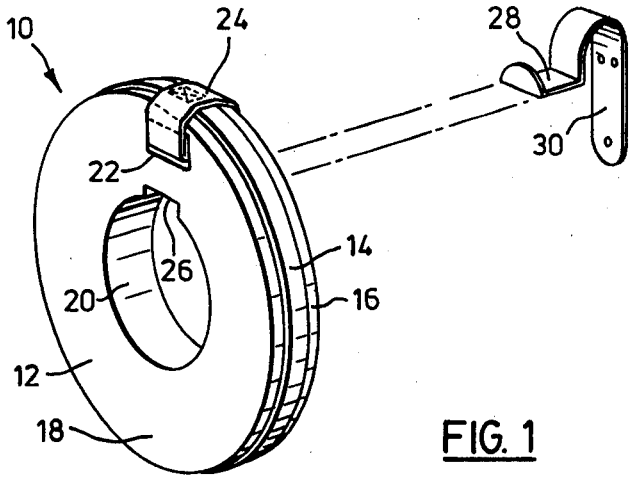
FIG. 1 is an exploded pictorial view of a flotation device and a support bracket for the flotation device.

With reference to FIG. 1 of the drawings reference numeral 10 refers generally to a flotation device constructed in accordance with an embodiment of the present invention. The flotation device 10 is in the form of a life buoy and consists of a flotation member 12 and a retrieval member 14. The flotation member 12 is in the form of a buoyant body of foamed plastics material such as soft vinyl closed cell foam. Preferably the entire body

Figure 2:
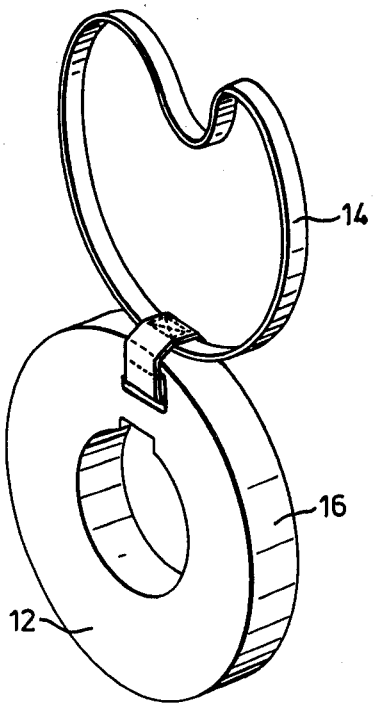
FIG. 2 is a pictorial view of the flotation device of FIG. 1 showing the retrieval member in the extended position.

12 is coated with a brightly coloured vinyl coating by dipping it in a vinyl polymer bath. The bright coloured coating such as a yellow coating serves to make the body readily visible and more water tight. The flotation member 12 is in the form of a ring having a support surface 16 extending about the periphery thereof, a pair of oppositely disposed annular faces 18 and an inner face 20. A slot 22 is formed in the body 12 and extends between the side faces 18. A band 24 extends through the slot 22 and around an adjacent section of the support face. The band 24 overlies the retrieval web 14 and serves to connect the flotation member and the web 14. Overlapping ends of the band 24 may be releasably secured to one another by means of oppositely disposed VELCRO (trade mark) strips or they may be sewn together or riveted together or otherwise secured. The retrieval member 14 illustrated in the embodiment of the invention illustrated in FIGS. 1 and 2 is in the form of a flat elongated web of flexible material arranged in the form of an endless band which is proportioned such that its peripheral length is substantially equal to and preferably slightly less than the circumferential length of the support face 16. The band 14 can be shorter than the perimeter of the support surface because the flexible material from which the flotation member is formed will yield to permit the band to extend around the support surface to be retained in the position shown in FIG. 1. The resilient nature of the plastics material from which the flotation member is formed will serve to permit it to expand into engagement with the retrieval member so as to retain the retrieval member in the storage position illustrated in FIG. 1 while being sufficiently flexible to facilitate the release of the web from the storage position shown in FIG. 1 to the operable position shown in FIG. 2.

A notch 26 is provided on the inner face 20. The notch 26 is proportioned to form a seat for receiving the support arm portion 28 of a mounting bracket 30 of a type which can be mounted on any convenient structure such as a wall or a fence so as to support the flotation member in a readily accessible position (ie near a pool or beach).

Figure 3:
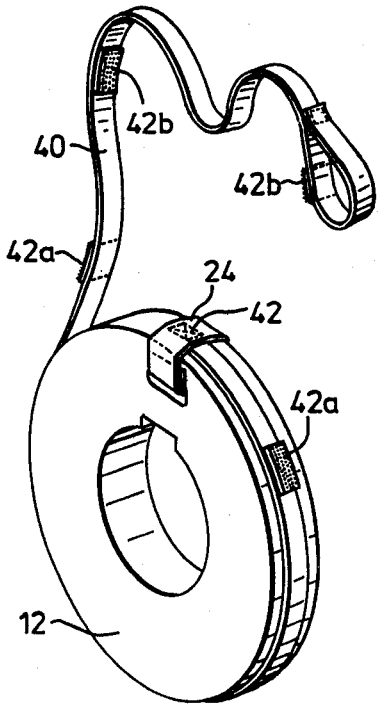
FIG. 3 is a pictorial view similar to FIG. 2 showing an alternative form of the retrieval device.

A further embodiment of the present invention is illustrated in FIG. 3 of the drawings wherein the flotation member 12 is constructed as previously described with respect to FIGS. 1 and 2 of the drawings. In this embodiment the retrieval member 40 is in the form of longitudinally elongated web which has a first end 42 secured to the cuff 24 by stitching or the like. One or more sets of complementary Velcro (trade mark) fasteners **42*a* and 42*b* are secured to the outer face and inner face respectively of the web 40 at spaced intervals along the length thereof. While two sets of Velcro fasteners are illustrated in FIG. 3** of the drawings, it will be understood that only the Velcro pad located on the inner face of the web adjacent the second end thereof and the complementary Velcro pad which is located on the outer face at the position which the inner pad will overlie when the web is wound around the support surface is required in order to retain the web in the fixed position in this embodiment. The additional Velcro pads are positioned along the length of the web so as to be arranged in a face to face interlocking relationship when the web is coiled around the support surface.

An elongated web which forms the retrieval member may be in the form of a flat strap of material such as nylon.

The support face 16 may be formed with a shallow transverse concave curvature so as to form a recessed seat for receiving the web, the curvature further serving to prevent an accidental removal of the web 14 from the support face. When cutting a body of foamed plastic material from a slab of plastic material, a concave curvature can be achieved mainly as a result of compression of the body by the cutting tool.

The flotation device of the present invention is simple and inexpensive to manufacture. The illustration member may be die-cut from a slab of closed cell foamed plastic material, or expanded in a mould that contains the negative shape of the flotation member 12. The exposed cells at the surface of the slab may be sealed by dipping the flotation member in a bath of vinyl material as previously described.

From the foregoing, it would be apparent that the flotation device of the present invention is simple and inexpensive to manufacture and provides a compact storage configuration of flotation member and retrieval member while ensuring that the retrieval member can be readily released.

I claim:

1. A flotation device comprising:

(a) a flotation member comprising a disc shaped buoyant body of resiliently flexible foamed plastics material having a cylindrical shaped support face extending about a perimeter thereof and across the full width thereof, said buoyant body being sufficiently resilient at said support surface to permit said support surface to be resiliently deformed, (b) a retrieval member comprising an elongated web of flexible material, said web being connected to said flotation member and adapted so as to be locatable in an operable position extending from its connection with said flotation member and a storage position extending about and resiliently depressing said support face to be retained thereon by the resilient reaction of the body.

2. A flotation device as claimed in caim 1 wherein said web is in the form of an endless loop which has a length slightly less than the length of said perimeter so as to resiliently deform said support surface so as to be self-supporting on said support face when located in said storage position.

3. A flotation device as claimed in claim 1 wherein said web has first and second ends at opposite ends thereof, said web being connected to said flotation member at said first end, said second end being releasably securable with respect to said support face when in said storage position.

4. A flotation device as claimed in claim 1 wherein said web is in the form of a flat strap having a width which is less than the width of said support face so as to be spaced inwardly from the edges of said support face when located in said storage position.

* * * * *